US008548622B2

(12) United States Patent
Berns et al.

(10) Patent No.: US 8,548,622 B2
(45) Date of Patent: Oct. 1, 2013

(54) UNIFORM COMPRESSION GARMENT AND METHOD OF MANUFACTURING GARMENT

(75) Inventors: Jason Berns, Baltimore, MD (US); William Mickle, Raleigh, NC (US); Mari Lucero, Baltimore, MD (US); David Ayers, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 484 days.

(21) Appl. No.: 12/841,829

(22) Filed: Jul. 22, 2010

(65) Prior Publication Data

US 2011/0016602 A1 Jan. 27, 2011

Related U.S. Application Data

(60) Provisional application No. 61/227,667, filed on Jul. 22, 2009.

(51) Int. Cl.
*G06F 19/00* (2011.01)

(52) U.S. Cl.
USPC ..... 700/132; 700/130

(58) Field of Classification Search
USPC ..... 700/130–132, 133
See application file for complete search history.

(56) References Cited

U.S. PATENT DOCUMENTS 5,163,007 A * 11/1992 Slilaty ..... 700/132
5,257,956 A 11/1993 Ewen
5,782,790 A 7/1998 Allen
6,101,424 A * 8/2000 Sawada ..... 700/132
6,353,770 B1 * 3/2002 Ramsey et al. ..... 700/131
6,546,309 B1 * 4/2003 Gazzuolo ..... 700/132
6,564,118 B1 * 5/2003 Swab ..... 700/131
6,711,455 B1 * 3/2004 Holloway et al. ..... 700/132
6,907,310 B2 * 6/2005 Gardner et al. ..... 700/132
6,936,021 B1 8/2005 Smith
7,020,538 B2 * 3/2006 Luhnow ..... 700/132
7,149,665 B2 * 12/2006 Feld et al. ..... 700/131
7,623,938 B2 * 11/2009 Luhnow et al. ..... 700/132

(Continued)

OTHER PUBLICATIONS

Duffield, R. et al., Comparison of Three Types of Full-Body Compression Garments on Throwing and Repeat-Sprint Performance in Cricket Players, British Journal of Sports Medicine, Mar. 6, 2007, p. 409-414, BMJ Publishing Group Ltd & British Association of Sport and Exercise Medicine.

*Primary Examiner* — Nathan Durham
(74) *Attorney, Agent, or Firm* — Maginot Moore & Beck LLP

(57) ABSTRACT

A method of manufacturing a compression garment comprises obtaining a plurality of model measurements at various locations on a model body. Thereafter, a plurality of garment dimensions are calculated for various locations on the garment. Each calculation of a garment dimension is based at least in part on one of the plurality of model measurements and at least in part on a target elongation for the garment. In at least one embodiment, calculations for various garment dimensions are performed by inserting the plurality of model measurements into a pattern equation that includes a model measurement variable and a target elongation variable. After calculating garment dimensions, a plurality of fabric segments are prepared for the garment based on the calculated dimensions. Each of the plurality of fabric sections comprise elastane and are characterized by a modulus of elasticity.

19 Claims, 4 Drawing Sheets

(56) References Cited

U.S. PATENT DOCUMENTS

2004/0078285 A1* 4/2004 Bijvoet ..... 705/26
2004/0186611 A1* 9/2004 Wang ..... 700/132
2005/0009445 A1 1/2005 Bell et al.
2005/0049741 A1* 3/2005 Dias et al. ..... 700/132
2006/0021390 A1 2/2006 Gebel et al.
2007/0149093 A1 6/2007 Lutz
2009/0025115 A1 1/2009 Duffy et al.

* cited by examiner

UNIFORM COMPRESSION GARMENT AND METHOD OF MANUFACTURING GARMENT

CROSS-REFERENCE TO RELATED APPLICATIONS

This application claims priority from U.S. Provisional Patent Application Ser. No. 61/227,667, filed Jul. 22, 2009.

FIELD

This application relates to the field of athletic garments and other apparel and particularly to compression garments.

BACKGROUND

Compression garments are generally comprised of one or more stretchable fabric segments characterized by a particular modulus of elasticity. When a wearer places the garment on his or her body, the fabric stretches around various body parts and applies a compressive force to the body parts.

Compression garments are sometimes used to facilitate post workout or post game recovery of particular body parts. For example, an athlete experiencing trauma to a knee during a sporting event may wear compression pants to help reduce swelling around the knee. The use of compression garments is sometimes preferred over the more traditional use of ice bags to control swelling, since compression garments may be used over a relatively long period without relative discomfort, dripping ice bags or other mess and inconvenience commonly associated with ice treatment.

While compression garments are sometimes used to treat injuries and trauma, traditional compression garments have certain downsides. In particular, traditional compression garments tend to provide different amounts of pressure to different parts of the body. For example, some current compression garments implement a graduated compression arrangement where the garment applies greater pressure to body parts at the extremities and generally less pressure to body parts closer to the heart. Thus, a compression pant may provide more compressive pressure in a calf area than in a quadriceps area. Other compression garments are simply cut in a manner that randomly applies different levels of compressive pressure to various body parts. This uneven compression is not ideal for recovery following physical trauma experienced from normal wear and tear from working out, as certain body parts may not be properly supported by the garment in a manner that promotes healing.

Another factor compounding the varying pressure offered by current compression garments is that different body types within a given size range may cause the garment to provide greater or less pressure to various body parts. For example, a first male requiring a size large pant may have relatively wide thighs, while a second male requiring the same size large pant may have relatively thin thighs, both having the same leg length. Thus, the first male with wide thighs wearing the large size pant will typically encounter significantly more compression in the thigh area than the second male with thin thighs wearing the same large size pant.

In view of the foregoing, it would be advantageous to provide a compression garment that provides a relatively consistent and precise compression force to substantially the entire body. It would also be advantageous if such garment could be manufactured to provide consistent compression performance across a wide variety of body types. Furthermore, it would be advantageous if such garment could be easily worn following a workout or other physical exertion activity in order to promote a relatively quick recovery with improved vitality, reduced swelling, increased power output and reduced muscle damage.

SUMMARY

A compression garment configured to be worn on a human body having a plurality of human body parts comprises a main body including a plurality stretchable fabric segments. The plurality of stretchable fabric segments are designed and dimensioned such that substantially the entire main body is stretched in order to cover the plurality of human body parts. The plurality of stretchable fabric segments are also designed and dimensioned to apply a uniform compression force to each of the plurality of body parts when substantially the entire main body is stretched to cover the plurality of human body parts.

A method of manufacturing the compression garment comprises first obtaining a plurality of model measurements at various locations on a model body. The model body represents a typical body configuration for a particular sized body. Next, a plurality of garment dimensions are calculated for various locations on the garment. Each calculation of a garment dimension is based at least in part on one of the plurality of model measurements and at least in part on a target elongation for the garment. In at least one embodiment, calculations for various garment dimensions are performed by inserting the plurality of model measurements into a pattern equation that includes a model measurement variable and a target elongation variable. After calculating garment dimensions, a plurality of fabric segments are prepared for the garment based on the calculated dimensions. Each of the plurality of fabric sections comprise elastane and are characterized by a modulus of elasticity.

In at least one embodiment, the equation used in calculating garment dimensions is $M=\frac{1}{2}B/(E+1)$, where M equals the flat measurement for the garment (i.e., ½ the pattern measurement); B equals the model measurement; and E equals the target elongation, the target elongation being a target percentage of fabric stretch expressed as a decimal.

In at least one embodiment, a uniform compression garment manufactured according to the disclosed method comprises a plurality of fabric segments connected together. Each of the plurality of fabric segments comprise about 22-30% elastic fibers, such as elastane or thermoplastic elastic fibers, with the elastic fibers having a linear mass density of about 40 to 80 denier. In addition, each of the plurality of fabric segments has a modulus of elasticity that is substantially the same in both a length direction and a width direction. The modulus of elasticity is such that a 0.5 to 3.0 pound load results in about 50% or more elongation of the fabric. In addition, the modulus of elasticity is substantially the same for each of the plurality of fabric segments, and the modulus of elasticity is such that the load at an elongation between 20% and 80% is relatively consistent. The 0.5 to 3.0 pound load may preferably be a 1.4 to 2.0 pound load. In at least one embodiment, the modulus of elasticity for the garment is such that a 25 to 35 pound load results in about 140% to 180% or more elongation.

The above described features and advantages, as well as others, will become more readily apparent to those of ordinary skill in the art by reference to the following detailed description and accompanying drawings. While it would be desirable to provide a garment that provides one or more of these or other advantageous features, the teachings disclosed herein extend to those embodiments which fall within the scope of any appended claims, regardless of whether they accomplish one or more of the above-mentioned advantages.

DESCRIPTION

Figure 1:
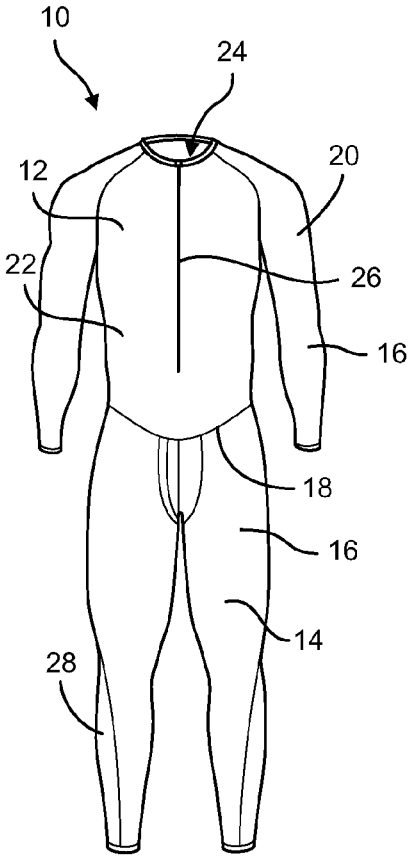
FIG. 1 shows an anterior view of a uniform compression garment in the form of a body suit.
Figure 2:
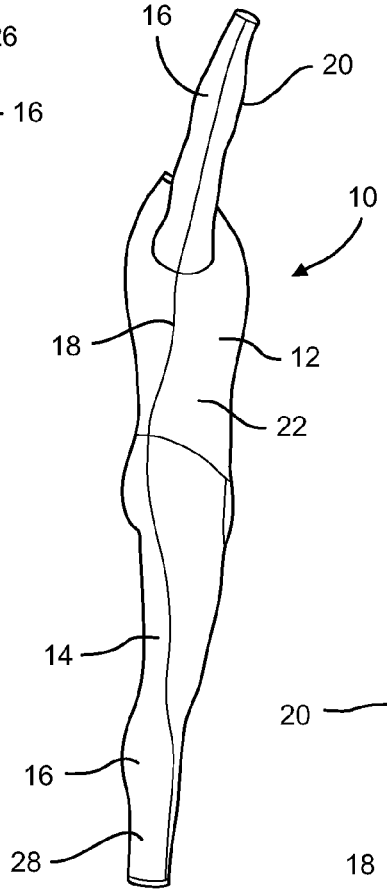
FIG. 2 shows a side view of the uniform compression garment of FIG. 1 with arms extended.
Figure 3:
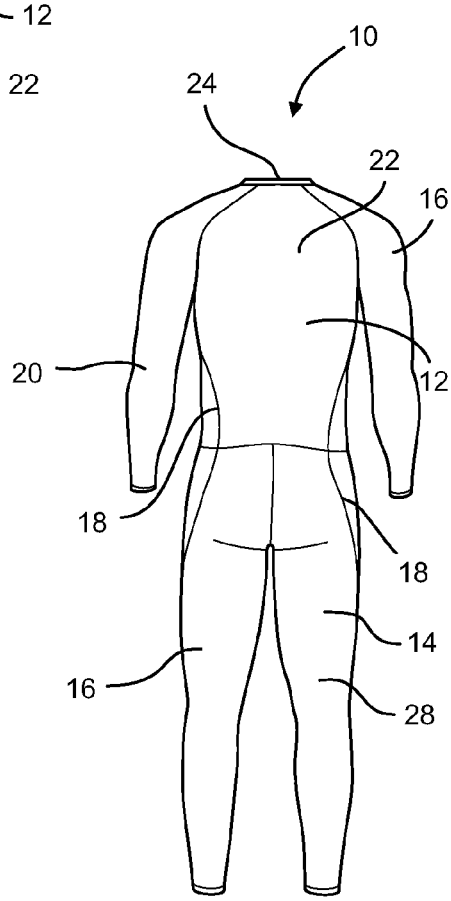
FIG. 3 shows a posterior view of the uniform compression garment of FIG. 1.

With reference to FIGS. 1-3, a uniform compression garment 10 is shown in the form of a full body suit. The garment 10 includes an upper body portion 12 and a lower body portion 14. The garment 10 is comprised of a plurality of fabric segments 16 connected at various seams 18 to form the garment 10.

The upper body portion 12 includes two arms 20 connected to a torso portion 22. The arms 20 are full length arms in the embodiment of FIGS. 1-3, extending from the shoulder to the wrists. The torso portion 22 includes anterior and posterior portions. A neck opening 24 is formed near the upper part of the torso portion. A zipper 26 extends downward from the neck opening 24 on the anterior of the torso portion. The zipper 26 acts to selectively enlarge or decrease the size of the neck opening 24 to allow the wearer to more easily get into or out of the body suit 10.

The lower body portion 14 is connected to the upper body portion 12. The lower body portion is generally comprised of two legs 28 extending from the torso portion 22. The legs 28 are full length legs in the embodiment of FIGS. 1-3, extending from the torso portion 22, through the thighs and to the ankles. In at least one alternative embodiment, the legs may also include stirrups near the ankles.

Although the garment 10 has been described as a unitary body suit in the exemplary embodiment of FIGS. 1-3, it will be recognized that the garment may take on any of numerous other forms. For example, the body suit may be comprised of separate upper and/or lower garments. Furthermore, while the garment 10 has been described as long sleeved and long legged, in other embodiments, the garment may be short sleeved or short legged. The garment 10 may also be provided as a single upper garment or a single lower garment.

The garment 10 is formed from a plurality of fabric segments 16 of various shapes. The fabric segments 16 are joined along the seams 18 to form the main body of the garment. Any acceptable means may be used to join the fabric segments, including stitching, adhesives, heat bonding, or any other connection means or combination thereof known to those in the art.

Each of the fabric segments 16 provide a substantially uniform degree of compression to the parts of the body covered by the garment 10. To this end, the modulus of elasticity is substantially the same for each of the plurality of fabric segments 16. Accordingly, substantially equivalent forces will stretch each of the fabric segments an equivalent amount. Furthermore, the modulus of elasticity for each fabric segment is substantially the same in both a length direction and a width direction such that the fabric has a balanced stretch.

In order to provide a substantially uniform degree of compression, the fabric segments 16 are also be cut to particular dimensions such that the each location on the garment 10 will stretch to approximately the same degree of elongation when placed on the body of a typical wearer. Accordingly, different locations on the garment 10 will have different circumferential measurements. For example, the garment 10 will be cut such that the bicep area has a greater circumference than the forearm area. Thus, even though the bicep of the wearer is typically larger than the forearm, the garment will be stretched to roughly the same degree in each area. Furthermore, the modulus of elasticity of the fabric segments is such that a normal deviation from a model size measurement may occur while still allowing the garment to provide a uniform degree of compression to the body parts of the wearer.

Figure 4:
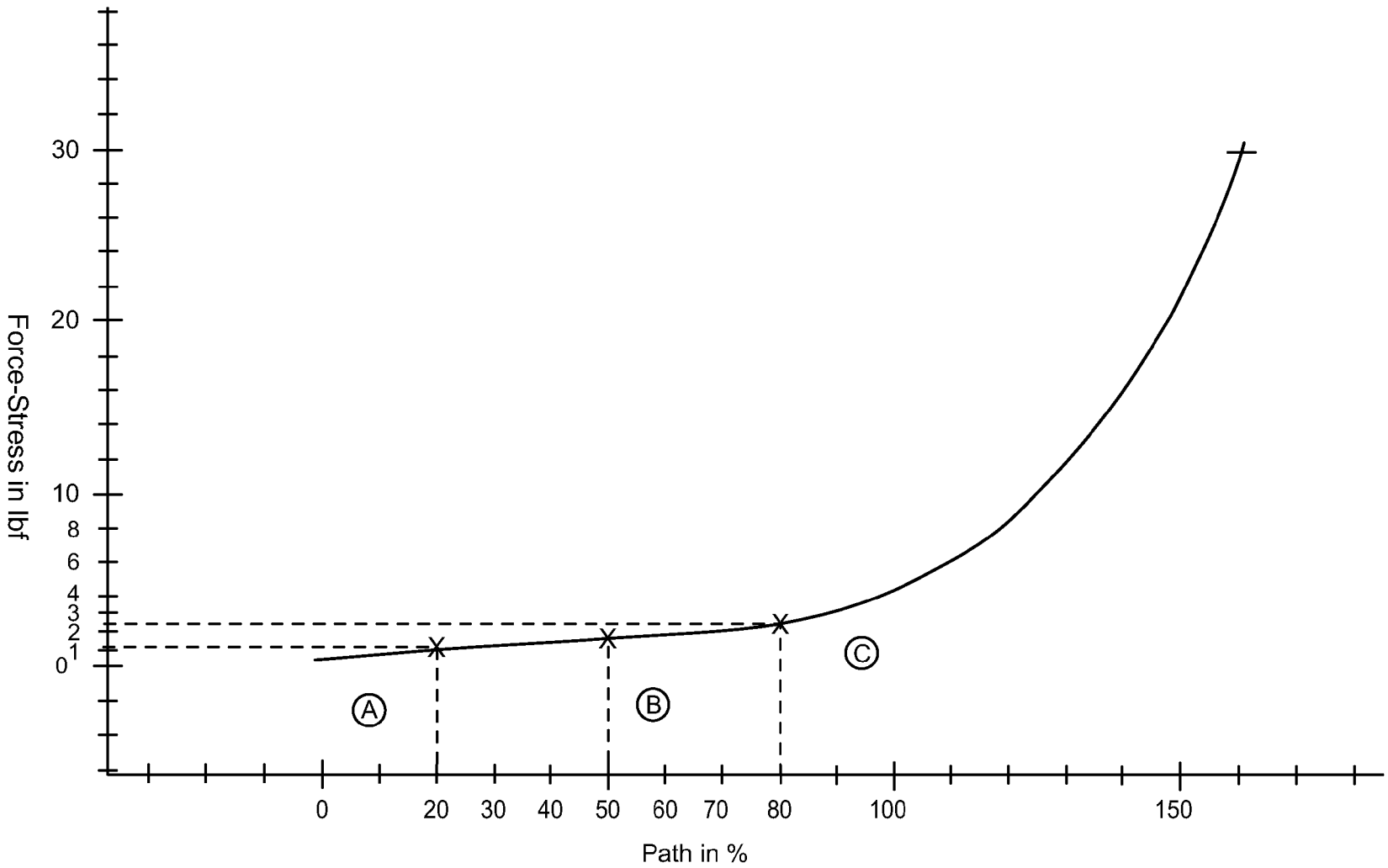
FIG. 4 shows a stress-strain curve for the uniform compression garment of FIG. 1.

A stress-strain curve for the fabric segments 16 having an exemplary modulus of elasticity is shown in FIG. 4. The stress-strain curve shows stress on the fabric along the y-axis in pounds-force and strain on the fabric along the x-axis in percentage elongation of the fabric. The curve of FIG. 4 shows an embodiment where a stress between 0.5 and 3.0 pounds-force is experienced at a strain of about 50% elongation of the fabric. More specifically, in the embodiment of FIG. 4 a stress between 1.4 and 2.0 pounds-force is experienced at a strain of about 50% elongation of the fabric.

It will be noted that the modulus of elasticity of the fabric segments 16 is such that a given stress range covers a wide range of strain. This is especially true for strain below 100% elongation. For example, in FIG. 4, while a 50% elongation is associated with a stress range between 1.4 and 2.0 pounds-force, the stress range between 1.4 and 2.0 pounds-force is not limited to only 50% elongation. Instead, as shown in FIG. 4, a stress range between 1.4 and 2.0 pounds-force is also experienced at strain ranges between 20% to 80% elongation of the fabric. In particular, at point A, a 1.4 pound-force may be experienced at 20% elongation of the fabric. At point B, a 1.7 pound-force may be experienced at 50% elongation. At point C, a 2.0 pound-force may be experienced at 80% elongation. Accordingly, when moving from the 50% elongation point B, to the 20% elongation point A or the 80% elongation point C, the 1.7 pound-force does not vary by more than 50%. More specifically, in the embodiment of FIG. 4, when moving from the 50% elongation point B to the 20% elongation point A, the 1.7 pound-force does not vary by more than even 20% (i.e., $(1.7-1.4)1.7<0.20$). Also, when moving from the 50% elongation point B to the 80% elongation point C, the 1.7 pound-force does not vary by more than 20% (i.e., $(2.0-1.7)1.7<0.20$).

From the example of points A, B and C in FIG. 4, it can be seen that the modulus of elasticity for the fabric segments 16 is such that the force required to achieve elongation of the fabric anywhere between 20% and 80% is relatively uniform. In particular, the load required to achieve 20% elongation of each fabric segment 16 is about a 1.4 pounds-force, and the load required to achieve 80% elongation of each fabric segment is about a 2.0 pounds-force. Accordingly, if the fabric segments 16 are properly designed and dimensioned, they are capable of holding a target modulus through a range of body types within a size. In other words, a properly designed garment may be used to apply a relatively uniform compressive force to a human body part through a relatively wide range of body part dimensions within the size.

With continued reference to FIG. 4, it can also be seen that the modulus of elasticity curve changes past the 100% strain point such that a relatively small range of stress does not cover a relatively wide range of strain. For example, in the curve of FIG. 4, the plurality of fabric segments 16 has a modulus of elasticity such that a 20 to 35 pounds-force results in about 140% to 180% elongation of the fabric. More particularly, a load of 30 pounds results in about 150% to 170% elongation of the fabric. The modulus of elasticity curve of FIG. 4 also shows that the fabric is constructed such that the stress does not begin to "spike" until about ¾ of the total elongation cycle is achieved. In other words, the slope of the modulus of elasticity curve (with stress is plotted against elongation) does not reach a critical slope greater than 1.0 until the fabric is stretched to about 75% or more of the possible degree of stretch. Fabric segments 16 having this type of a modulus of elasticity curve as shown in FIG. 4 are generally useful in providing a garment capable of applying a uniform degree of compression over a wide range of body types within a size.

With reference again to FIGS. 1-3, the stretchable fabric segments 16 make up a substantial majority of the garment. Accordingly, in various embodiments, the garment may comprise some minor portion of additional segments that are different from the fabric segments 16 that make up the main body of the garment. Examples of such additional segments include decorative segments or functional segments that provide ventilation for the garment or targeted compression. However, the substantial majority of the garment remains comprised of the fabric segments 16 that make up the main body portion. The term "primary fabric segments" is also used herein to refer to these fabric segments 16 that make up the main body portion of the garment 10.

The primary fabric segments 16 that make up the main body of the garment 10 are comprised of elastane fibers that are knit together with other fibers to form the fabric segments. The other fibers in the fabric segments 16 may comprise, for example, cotton, polyester, or any of other known fibers commonly used to produce compression garments. In at least one embodiment, the primary fabric segments 16 are formed using a circular knit single jersey construction. However, in other embodiments, the primary fabric segments 16 may be formed using a balanced circular knit interlock construction, tricot/raschel warp knit construction, or any of various other known fabric constructions, including knit, woven and non-woven fabrics.

In at least one embodiment, the elastane fibers comprise about 22-30% of the fibers in the primary fabric segments 16. More particularly, the primary fabric segments 16 may be comprised of 24% to 28% elastane, and preferably about 26% elastane. In at least one embodiment, the elastane fibers have a linear mass density of about 40 to 90 denier. More particularly, the elastane fibers have a linear mass density of 55 to 70 denier, and preferably a linear mass density of about 70 denier.

With a garment 10 having primary fabric segments 16 as described in the above embodiments, the garment 10 is capable of providing a uniform compression force around the limbs and torso of a wearer. This uniform compression applies power and support evenly throughout the body and facilitates recovery from physical exertion by preventing water from rushing into and around damaged tissue and muscle fibers. The application of uniform pressure around the body also assists with muscle alignment and posturing, thus helping to reconnect broken muscle fibers and hold the muscles in place. The uniform compression garment is advantageously designed to apply a consistent compression force to a range of body types within a size. In particular, the primary fabric segments are capable of holding a target modulus of elasticity through a range of fabric elongations. For example, as described above, in at least one embodiment, the primary fabric segments may be constructed such that a 20% to 80% elongation of the primary fabric segments results in a compressive force in a range between 1.4 to 2.0 pounds-force.

Figure 5:
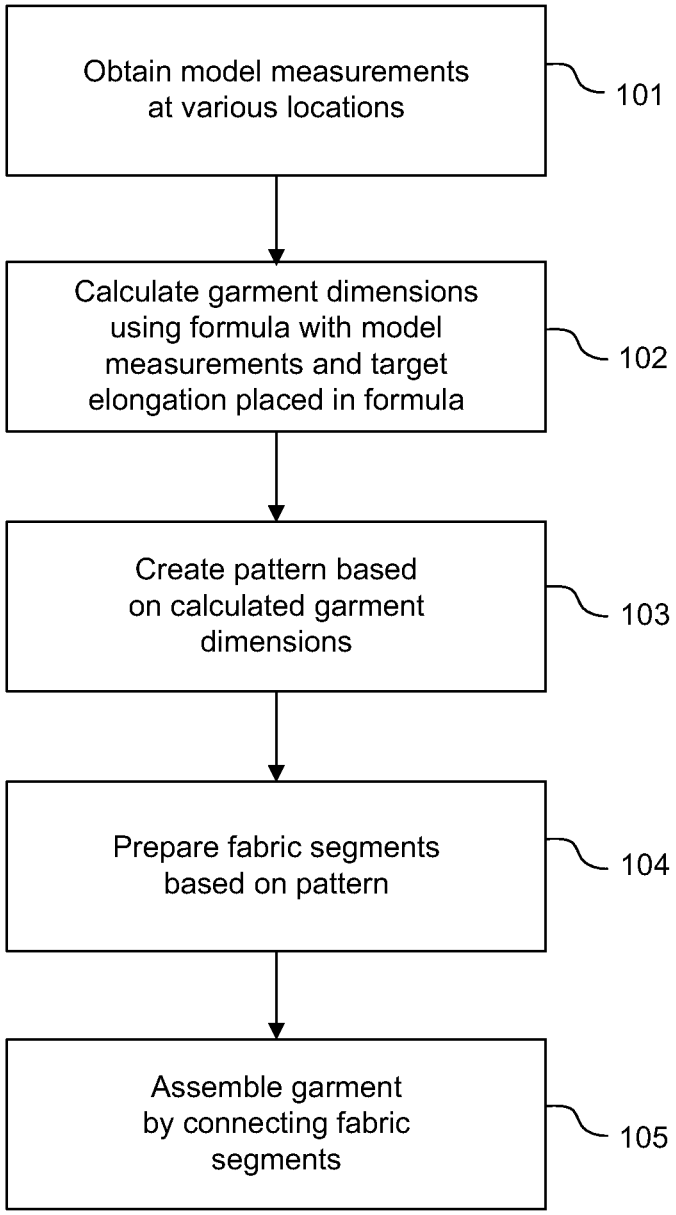
FIG. 5 shows a flowchart of a method for manufacturing the uniform compression garment of FIG. 1.

With reference now to FIG. 5 a flow-chart is shown representing a method of manufacturing the garment of FIGS. 1-3. The method begins at step 101 by obtaining model measurements at multiple locations on a model body. The model body represents a typical body configuration for a particular sized body. Thus, a manufacturer will typically have several model bodies available, each relating to different garment sizes, such as models representing small, medium, large and extra-large sizes. When making a particular sized garment (e.g., a medium size), the manufacturer/designer uses measurements from that particular model (e.g., the medium size model).

Each model provides typical measurements for a range of body types within the garment size. Thus, the model will typically represent median or average measurements for individuals wearing that size garment. To obtain these median measurements within a particular garment size and create the model, measurements are taken at particular locations for a large population of individuals in a given garment size (e.g., an XL size). Individuals wearing a particular size garment are typically identified by a combination of height and weight of the individual. Once measurements are obtained, the measurements at a particular body location may then be presented in a bell curve format in order to find the median measurements for the population at that particular measurement location. Each measurement in the model represents this median measurement at the particular measurement location for the population of similarly sized individuals. For example, if mid-thigh circumference measurements for the group range between 20 and 30 inches with a median measurement of 24, the mid-thigh measurement of the model would be 24 inches.

Figure 6:
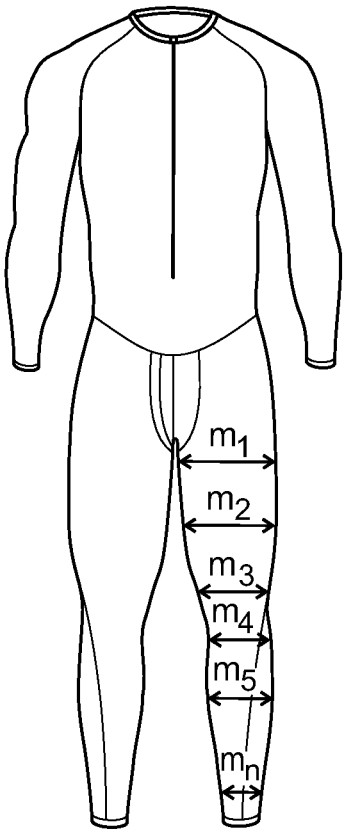
FIG. 6 shows a model body for use in manufacturing the garment of FIG. 1, and a plurality of measurement locations along the leg of the model body.

In addition to exhibiting median measurements within a size, the model also typically includes numerous measurements for various body parts. For example, FIG. 6 shows an exemplary model with various measurement locations along a leg represented by $m_1$, $m_2$ . . . $m_n$. The designer/manufacturer of the garment may choose to consider all of these measurements or only some of the measurements when designing and manufacturing the garment.

The model and its associated measurements are typically stored in electronic form in a computer memory. A graphical representation of the model, such as the one in FIG. 6, may be printed and viewed by the manufacturer/designer. This graphical representation would also typically include the measurements at various measurement locations on the model. In addition to the computer model, a physical model may also be used to allow the designer/manufacturer to view a prototype garment on the model.

With reference again to the flowchart of FIG. 5, once measurements are obtained from the model body, the designer/manufacturer calculates actual garment dimensions in step 102. The garment dimensions are calculated at various locations on the garment that correlate with the area where measurements were obtained from the model. Thus, if three different thigh measurements are obtained from the model, three different garment dimensions may be calculated for the thigh area. For example, if an upper thigh measurement ($m_1$), mid-thigh measurement ($m_2$), and lower thigh measurement ($m_3$) are all obtained from the model, an upper thigh dimension, mid-thigh dimension, and lower thigh dimension may all be calculated for the garment. It will be recognized that any number of measurements may be taken for a given body part and calculated as garment dimensions, limited only by practical considerations. Thus, although an infinite number of measurements are theoretically possible along the thigh, the designer/manufacturer may only choose to select a limited number of measurements, such as interval measurements every six inches along the thigh.

In addition to the model measurements, the garment dimension calculation is also based in part on a target elongation for the garment. The target elongation is an amount of stretch for the garment that is required to apply a predetermined compressive force to the model body. Because this amount of stretch can occur anywhere within a range, the target elongation may be expressed as a medial amount of stretch within a range. Thus, if stretch amounts between 20% and 80% are capable of applying the desired compressive force to the model body, the target elongation may be at the center of this range, i.e., at 50% elongation. When the target elongation falls within a range of elongation amounts capable of delivering the desired compression force, the desired amount of fabric stretch and related compressive force will still be delivered to various body sizes that differ from the model body.

In at least one embodiment, the calculation of garment dimensions is performed according to the following pattern equation:

$$M=\tfrac{1}{2}B/(E+1)$$

Where M equals the flat dimension for the garment at a particular garment location (i.e., ½ the actual pattern measurement); B equals the model measurement (i.e., circumference of the model at a model location that is associated with the garment location); and E equals a target elongation (i.e., a target percentage of fabric stretch expressed as a decimal). The flat dimension for the garment (M) means the dimension across the garment when the garment is lying on a flat surface, or in other words, ½ the garment circumference at the garment location.

As an example calculation using the above equation, consider a particular garment where the designer/manufacturer has determined that the primary fabric segments 16 should stretch anywhere between 30% and 70% in order to deliver the desired compressive force when placed on a body within a given size. The target elongation is in the middle of this 30-70% range at 50% elongation (i.e., E=0.50). Using the measurements obtained from various locations on the model, the manufacturer/designer can calculate the flat dimensions at related locations on the garment using the equation M=½B/(E+1). If the upper thigh measurement on the model is 24 inches, the flat dimension of the garment at this upper thigh location can be calculated as M=(½)24 (in.)/(0.50+1)=8 (in.). Similarly, if the lower thigh measurement on the model is 18 inches, the flat dimension of the garment at this lower thigh location can be calculated as M=(½)18 (in.)/(0.50+1)=6 (in.).

With reference again to FIG. 5, once the garment dimensions have been calculated, a pattern may be created based on the calculated garment dimensions, as noted in step 103. In the above calculation, M=8 inches at the upper thigh location and 6 inches at the lower thigh location. Such a pattern would include a gradual transition between the 8 inch diameter and 6 inch diameter portions. In addition, since the calculated variable M is equal to the width dimension across the garment when the garment is lying on a flat surface (i.e., ½ the garment circumference), the pattern for the garment is designed such that the garment circumference will be twice this flat measurement at the corresponding body locations (i.e., the actual garment circumference at the corresponding body location is 2M). Various strategies may be used to double the calculated width, such as cutting fabric segments to twice the calculated width and joining the opposing ends, or cutting two equally sized fabric segments and joining the segments along the edges. In any event, the final circumference of the garment at any given body location should equal twice the calculated flat measurement (M) for that body location.

After the pattern is created in step 103, the next step is preparation of actual primary fabric segments 16 for the garment according to the pattern, as noted in step 104 of FIG. 6. The primary fabric segments are typically cut from a long swath of fabric. However, it is also possible to create the primary fabric segments in the desired segment shape and size (i.e., according to the pattern) at the same time the fabric is made.

After the primary fabric segments are created in step 104, the garment is assembled in step 105. Assembly of the garment involves connecting the edges of the primary fabric segments along seams. The edges of the primary fabric segments may be connected in any of various manners known in the art, including sewing, thermal bonding, adhesive bonding or any other known connection method. Assembly of the garment in step 105 also includes connecting any other fabric segments or accessories to the garment, such as zipper 26 shown in FIG. 1, and any garment finishing, such as decorative components or reinforcement of bottom hems in leg portions 14.

As set forth above, a model for a given size range may be created based on median measurements from a population of individuals. Using the model measurements, a garment may be created that is capable of applying a relatively uniform compressive force to a human body part through a relatively wide range of body part dimensions within a particular size. The dimensions of the garment coupled with the stretch characteristics of the fabric allow the garment to apply a uniform compressive force to nearly all individuals within a given size range (e.g., from about 5% to 95% of individuals on the bell curve for a given size range). In some embodiments, the garment may be designed to apply the same compressive force to all body parts and locations (e.g., the leg receives the same compressive force as the abdomen). In other embodiments, the uniform compressive force may vary between body parts and locations (e.g., the leg receives a greater compressive force than the abdomen). However, in either embodiment, the garment is capable of applying a relatively uniform compressive force at each garment location to the vast majority of individuals who fit within the garment size.

Although the present invention has been described with respect to certain preferred embodiments, it will be appreciated by those of skill in the art that other implementations and adaptations are possible. For example, although an embodiment with seams has been described herein, a seamless embodiment is also possible. Moreover, there are advantages to individual advancements described herein that may be obtained without incorporating other aspects described above. Therefore, the spirit and scope of any appended claims should not be limited to the description of the preferred embodiments contained herein.

What is claimed is:

1. A method of manufacturing a garment comprising:

obtaining a plurality of model measurements, each of the model measurements associated with a location on a model body, the model body representing normal body dimensions for a range of bodies within a particular garment size;

calculating a plurality of garment measurements for various locations on the garment, wherein each garment measurement calculation is based at least in part on one of the plurality of model measurements and at least in part on a target elongation for the garment; and preparing a plurality of fabric segments for the garment based on the calculated garment measurements, wherein a modulus of elasticity is substantially the same for each of the plurality of fabric segments and wherein the modulus of elasticity is such that a 0.5 to 3.0 pound force results in at least 50% elongation of the fabric segment.

2. The method of claim 1 wherein the model measurements from the model body are median measurements from a population of individuals having bodies that fit within the particular garment size.

3. The method of claim 2 wherein the target elongation for the garment is determined based on an elongation that will provide a uniform compressive force to most of the population of individuals wearing the garment.

4. The method of claim 3 wherein the target elongation for the garment is determined based on an elongation that will provide a uniform compressive force to about 90% of the population of individuals having bodies that fit within the particular garment size.

5. The method of claim 1 wherein the model measurements are associated with different locations on the model body including at least one limb location and at least one torso location, wherein the garment measurement calculations are associated with a plurality of garment locations including at least one limb and at least one torso, and wherein the target elongation for the garment is within an elongation range determined to provide a uniform compressive force to a wearer at each of the plurality of garment locations.

6. The method of claim 1 wherein the model body is a graphical model body and the model measurements are obtained by referencing a database of model measurements stored in a memory.

7. A method of manufacturing a garment comprising:

obtaining a plurality of model measurements, each of the model measurements associated with a location on a model body, the model body representing normal body dimensions for a range of bodies within a particular garment size;

calculating a plurality of garment measurements for various locations on the garment, wherein each garment measurement calculation is based at least in part on one of the plurality of model measurements and at least in part on a target elongation for the garment, wherein calculating the plurality of garment measurements is performed by inserting the plurality of model measurements into a pattern equation, the pattern equation comprising a model measurement variable and a target elongation variable, wherein a value of the model measurement variable differs based on a model measurement associated with a garment location; and preparing a plurality of fabric segments for the garment based on the calculated garment measurements.

8. The method of claim 7 wherein the pattern equation is $M=\frac{1}{2}B/(E+1)$ wherein M equals the flat measurement for the garment at the garment location, wherein B equals the model measurement associated with the garment location, and wherein E equals the target elongation.

9. The method of claim 8 wherein E is a constant such that the target elongation is uniform for the entire garment.

10. The method of claim 7 wherein the model body is a graphical model body and the model measurements are obtained by referencing a database of model measurements stored in a memory.

11. The method of claim 7 wherein each of the plurality of fabric segments has a modulus of elasticity that is substantially the same in both a length direction and a width direction.

12. The method of claim 7 wherein the model measurements from the model body are median measurements from a population of individuals having bodies that fit within the particular garment size.

13. The method of claim 7 wherein the target elongation for the garment is determined based on an elongation that will provide a uniform compressive force to most of the population of individuals wearing the garment.

14. The method of claim 13 wherein the target elongation for the garment is determined based on an elongation that will provide a uniform compressive force to about 90% of the population of individuals having bodies that fit within the particular garment size.

15. A method of manufacturing a garment comprising:

obtaining a plurality body measurements from a population of individuals having bodies that fit within a particular garment size;

determining a plurality of median or normal measurements from the population of individuals;

calculating a plurality of garment measurements associated with a plurality of locations on the garment including at least one torso location and at least one limb location, each of the plurality of garment measurements based at least in part on one of the plurality of median or normal measurements and at least in part on a target elongation for the plurality of locations on the garment, wherein the target elongation for the plurality of locations on the garment is within an elongation range that will provide a uniform compressive force at each of the plurality of locations on the garment to a substantial majority of the population of individuals; and preparing a plurality of fabric segments for the garment based on the calculated garment measurements.

16. The method of claim 15 wherein calculating the plurality of garment measurements is performed by inserting the plurality of median or normal measurements into a pattern equation, the pattern equation comprising a measurement variable and a target elongation variable.

17. The method of claim 15 wherein the target elongation for the plurality of locations on the garment is determined based on an elongation that will provide a uniform compressive force to most of the population of individuals wearing the garment at the plurality of locations on the garment.

18. The method of claim 15 wherein each of the plurality of fabric segments has a modulus of elasticity that is substantially the same in both a length direction and a width direction.

19. The method of claim 15 wherein a modulus of elasticity is substantially the same for each of the plurality of fabric segments and wherein the modulus of elasticity is such that a 0.5 to 3.0 pound force results in at least 50% elongation of the fabric segment.

* * * * *